US006725566B1

(12) United States Patent
Skrotsky et al.

(10) Patent No.: US 6,725,566 B1
(45) Date of Patent: Apr. 27, 2004

(54) DRYING PLANT AND METHOD FOR DRYING WOOD

(76) Inventors: Viktor Georgievich Skrotsky, deceased, late of Moscow (RU); Olga Panteleimonovna Skrotskaya, ul. Akademika Yangelia, d.g., kv. 155, 113534 Moscow (RU)

( * ) Notice: Subject to any disclaimer, the term of this patent is extended or adjusted under 35 U.S.C. 154(b) by 0 days.

(21) Appl. No.: 10/110,491

(22) PCT Filed: Oct. 24, 2000

(86) PCT No.: PCT/RU00/00419

§ 371 (c)(1),
(2), (4) Date: Apr. 15, 2002

(87) PCT Pub. No.: WO01/31270

PCT Pub. Date: May 3, 2001

(30) Foreign Application Priority Data

Oct. 27, 1999 (RU) ..... 99122270

(51) Int. Cl.[7] ..... F26B 7/00

(52) U.S. Cl. ..... 34/396; 34/518; 34/77; 34/92

(58) Field of Search ..... 110/224, 233, 110/303, 308; 34/391, 396, 402–404, 406, 409, 412, 450, 474, 479, 491, 493, 509, 518, 62, 77, 92, 202, 219, 225

(56) References Cited

U.S. PATENT DOCUMENTS 4,017,254 A * 4/1977 Jones ..... 432/72
4,520,791 A * 6/1985 Chamberlain ..... 126/518
5,815,945 A * 10/1998 Ando ..... 34/269
5,943,789 A * 8/1999 Yamamoto ..... 34/418
6,332,411 B1 * 12/2001 Skrotskaya et al. ..... 110/297

FOREIGN PATENT DOCUMENTS

EP 0266516 5/1998
JP 3-79983 A * 4/1991 ..... F26B/21/00

(List continued on next page.)

OTHER PUBLICATIONS

Spravochnik po sushke drevesiny (Wood–drying reference book) edited by E. S. Bogdanov, Moscow, Lesnaya promyshlennost, 1990, pp. 38–63.

*Primary Examiner*—Ira S. Lazarus
*Assistant Examiner*—Andrea M. Ragonese
(74) *Attorney, Agent, or Firm*—Collard & Roe, P.C.

(57) ABSTRACT

The invention relates to drying equipment and can be used in wood and wood treatment industries, etc., whenever parameters and procedures necessary to dry materials such as wood are used. The invention allows the drying process to achieve a higher degree of environmental protection, a larger product output and power saving features on the account of the following design of the plant: the drying chamber (1) which contains the material to be dried includes a bottom (4) which has two cavities (5,6); hot combustion products are injected into one of these cavities (5) from the flue pipe (9) of the furnace (3) which is used to burn wood waste; hot air is supplied into the other cavity (6), whereby said air is heated in pipes which are located in the flue (9), and is used as a drying agent. The hot drying agent is supplied from the cavity (6) in the bottom and circulates through air distribution channels in the lower part of the drying chamber (1) where it passes through the material to be dried and rises in the top portion of the internal open space of the drying chamber (1). From that point, one part of the drying agent is fed into a closed circuit in the flue (9) of the furnace and is heated therein, and the other part of said drying agent is directed into a condensate cleaning unit (11) where it is mixed with furnace gases and purifies these gases by condensation.

25 Claims, 4 Drawing Sheets

FOREIGN PATENT DOCUMENTS

| | | | |
|---|---|---|---|
| JP | 11051560 | | 2/1999 |
| JP | 11094460 | | 4/1999 |
| JP | 11201639 | | 7/1999 |
| JP | 11241883 | | 9/1999 |
| RU | 2102662 | | 1/1998 |
| RU | 2105941 | | 2/1998 |
| SU | 10935 | A | 9/1929 |
| SU | 11380 | A | 9/1929 |
| SU | 52692 | A | 2/1938 |
| SU | 380454 | | 1/1971 |

* cited by examiner

DRYING PLANT AND METHOD FOR DRYING WOOD

CROSS REFERENCE TO RELATED APPLICATIONS

Applicants claim priority under 35 U.S.C. §119 of Russian Application No. 99122270, filed Oct. 27, 1999. Applicants also claim priority under 35 U.S.C. §365 of PCT/RU00/00419 filed Oct. 24, 2000. The international application under PCT article 21 (2) was not published in English.

TECHNICAL FIELD

The invention relates to drying equipment and can be used in timber industry, woodworking and other branches of industry, whenever parameters and procedures necessary to dry materials as wood are used.

Prior Art

Drying plants are known from prior art that include a batch-operating drying chamber and a furnace located near it, in which woodworking waste products may be and are primarily used as fuel to generate heat necessary for drying. Usually, the furnace gases or a mixture of furnace gases with air are used in such systems (e.g., see, Spravochnik po sushke drevesiny (Wood-drying reference book) edited by E. S. Bogdanov, Moscow, Lesnaya promyshlennost, 1990, pp. 38–63, patent RU 2105941, and the following inventor's certificates: SU:380454, JP09223628, JP11094460, JP11201639, JP11241883). While using those systems, accompanying problems inevitably appear due to the following facts. Gaseous combustion products of high-temperature wood burning consist largely of $CO_2$, $H_2O$ and nitrogen oxides $NO_x$. The situation becomes much more complicated when an incomplete fuel combustion takes place, because in this case the combustion products are fouled not only with soot (i.e., unburned carbon particles), but also with dry distillation products as well, consisting of CO and a number of hydrocarbons, which are usually chemically active, smell specifically, have relatively low temperatures of boiling, etc. Furthermore, there is a risk of environmental pollution due to a possible formation of dioxins and furans as a result of condensation reactions, when gaseous products of wood burning are cooled with the presence of even minimal amounts of chlorine (although furnace ashes do not contain these products).

As a result, to ensure ecological safety of the drying plants and to produce high-quality dry wood materials, considerable expenses are required to purify combustion products and drying agents. Besides, special devices are required to provide necessary drying conditions (e.g., different humidifiers or steam generators are used to maintain the necessary level of humidity), resulting in a sophisticated design, higher prices and complicated maintenance. Nevertheless, neither the measures taken nor considerable expenses can guarantee either necessary ecological safety or high quality of dried materials.

Specification

The subject of the present invention is to ensure higher ecological safety and provide a highly productive, power-saving drying process, allowing to produce high quality dried materials. The proposed drying plant is not expensive, simple in maintenance and does not require highly qualified personnel. The drying plant can be installed either in existing premises or in the form of a separate premise, e.g. at lumbering sites.

The proposed drying method is as follows: stack the wood into the free internal space of the drying chamber, close the chamber, and supply a hot drying agent (the air heated in the pipes located in the furnace flue) into the chamber. The woodworking waste products are the primary fuel used in the furnace. The air is forcedly circulated from pipes located in the furnace flue to the lower part of the free internal space of the drying chamber, and from the upper part of the free internal space of the drying chamber into the pipes of the furnace flue, and backwards. During drying, a portion of cooled and humidified air from the upper part of the free internal space of the drying chamber is forcedly supplied into the condensate cleaning unit, where it is mixed with the furnace gases, which are also forcedly supplied into the unit for purification; on their way to the cleaning unit, the furnace gases pass through a cavity located in the bottom of the drying chamber providing additional heating of the chamber. Air circulation from the pipes of the furnace flue to the lower part of the free internal space of the drying chamber and from its upper part into the pipes located in the furnace flue, and forced supply of furnace gases through an exhaust pipe into the cavity in the bottom of the drying chamber and then into the condensate cleaning unit, as well as forced supply of a portion of cooled and humidified air from the upper part of the free internal space of the drying chamber into the condensate cleaning unit, is realized with the aid of three appropriate exhaust ventilators. The pressure in the free internal space of the drying chamber falls slightly during drying. Humidity conditions can be adjusted by releasing vapor from the upper part of the free internal space of the drying chamber into atmosphere.

Temperature conditions can be regulated by adjusting air circulation intensity from the pipes of the furnace flue to the lower part of the free internal space of the drying chamber and from the upper part of the free internal space of the drying chamber into the pipes; temperature conditions can also be regulated by adjusting the temperature of the drying agent (air), which depends on burning intensity and the amount of fuel in the furnace.

The proposed method for drying wood may be realized as a drying plant consisting of a heat-insulated drying chamber with a free internal space, a furnace located close to the drying chamber, and facilities for supplying drying agent from the furnace into the drying chamber. The bottom of drying chamber is designed with two cavities horizontally arranged and hermetically separated from each other. The partition between these cavities is made of diathermic material. The lower cavity in the bottom of the drying chamber is designed in such a way as to provide forced feeding of furnace gases into the cavity from the exhaust pipe of the furnace flue. The upper cavity located in the bottom of the drying chamber is designed in such a way as to provide supply of the air heated in the furnace flue into the cavity; in the upper cavity, the heated air is distributed among air distribution channels to interact with the material to be dried located in the free internal space of the drying chamber at specially arranged places. There is a possibility to provide forced feeding of a portion of the air cooled and humidified during drying from the upper part of the free internal space of the drying chamber into the furnace flue. Besides, the drying plant is equipped with a condensate cleaning unit located outside the drying chamber; the furnace gases are forcedly fed into the unit after they pass through the lower cavity in the bottom of the drying chamber; also, a portion of cooled and humidified air is forcedly fed into the unit from the upper part of the free internal space of the drying chamber for mixing up with the furnace gases to form a condensate; after that, the purified air is exhausted into atmosphere.

The facilities that forcedly supply furnace gases from the exhaust pipe of the furnace flue to the lower cavity in the bottom of the drying chamber and into the condensate cleaning unit after they pass through the lower cavity, are designed in the form of the first exhaust ventilator (smoke exhauster) located outside the drying chamber and condensate cleaning unit and connected to the outlet of the lower cavity in the bottom of the drying chamber and to the inlet of the condensate cleaning unit.

The facilities that supply a portion of cooled and humidified air from the upper part of the free internal space of the drying chamber into the condensate cleaning unit are designed in the form of the second exhaust ventilator located outside the drying chamber and the condensate cleaning unit and connected to both of them.

The facilities that bleed a portion of cooled and humidified air from the upper part of the free internal space of the drying chamber and supply it into the furnace flue are designed in the form of the third exhaust ventilator connected both to the drying chamber and the furnace flue so as to provide the closed air circulation from the upper part of the free internal space of the drying chamber into the furnace flue and from the furnace flue into the upper cavity in the bottom of the drying chamber and further into the free internal space of the drying chamber.

A casing of the third exhaust ventilator is connected to an outgoing pipe intended to discharge into atmosphere moisture which is accumulated on the internal surface of the casing as a result of condensation of cooled and humidified air bled by the third exhaust ventilator from the upper part of the free internal space of the drying chamber. The outgoing pipe is equipped with a shutter to adjust humidity conditions of the drying process. The furnace flue contains a pipe where the air is heated by the furnace gases and then fed into the drying chamber and backwards, thus supporting the process of drying. The pipe is curved many times to increase the way and time for the air to go through the furnace flue, enabling maximum heat transfer from the furnace gases to the air in the pipe.

A shutter for adjusting temperature conditions of the drying process is installed in the channel, designed for forced air supplying from the upper free space of the drying chamber into the furnace flue.

The lower cavity in the bottom of the drying chamber is equipped with at least two partitions to provide labyrinth passing of furnace gases. It increases heat emission from the furnace gases to the walls of the lower cavity, and therefore, provides additional heating of the drying chamber.

The air distribution channels are perpendicular to the direction of the heated airflow fed into the upper cavity in the bottom of the drying chamber. These channels are located between and along the areas for placing the material to be dried; each air distribution channel is separated with a vertical partition from an adjacent area for placing the material to be dried.

The areas for placing the material to be dried are located on/above the upper surface of the diathermic partition between the upper and lower cavities in the bottom of the drying chamber so as to allow heated air to pass through the material to be dried while moving up to the upper part of the free internal space of the drying chamber. The areas for placing the material to be dried are equipped with the vertical partitions to direct and distribute the heated air. First, the heated air passes the free space of the upper cavity in the bottom of the drying chamber through the air distribution channels, and then it is supplied to the material being dried.

There is an additional possibility to supply heated air to the material being dried via the through holes in the vertical partitions that separate the areas for placing the material to be dried from the air distribution channels. These holes have different diameters that increase along the way of heated air passage via the air distribution channels. These holes are equipped with shutters.

In the upper surface of the upper cavity in the bottom of the drying chamber, close to one of its lateral walls, there are the through holes, which provide additional hot air supply from the upper cavity in the bottom of the drying chamber into the free internal space of the drying chamber. In case the drying chamber is used for drying saw-timber piles, which is located along the air distribution channels, the through holes are made near the ends of the piles.

When the drying chamber is not completely loaded, it is possible to close the air distribution channel adjacent to the area for placing the material to be dried, which contains no material.

The condensate cleaning unit is designed in the form of a hollow reservoir to ensure condensation on its internal walls, when cooled and humidified air fed from the upper part of the free internal space of the drying chamber gets mixed up with the furnace gases from the lower cavity in the bottom of the drying chamber.

The power capacity of the third exhaust ventilator is higher than the power capacity of the second exhaust ventilator. The volume of the free internal space of the drying chamber determines the values and ratios of the power capacities of the second and third ventilators.

BRIEF DESCRIPTION OF DRAWINGS

The design of the proposed drying plant is illustrated in the following figures.

DESCRIPTION OF PREFERRED EMBODIMENT

Figure 1:
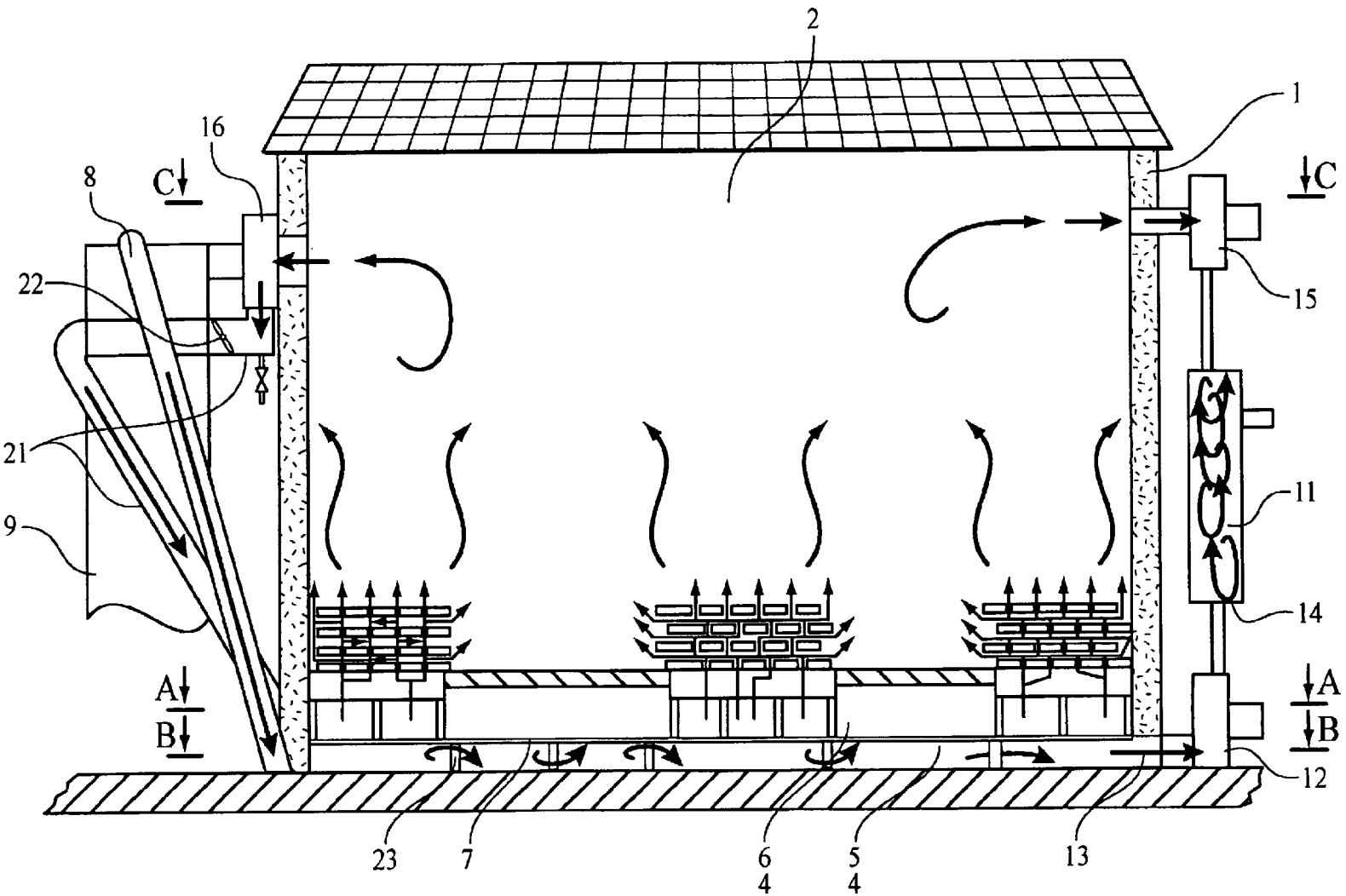
In FIG. 1, a cross-section of the drying plant is given.
Figure 2:
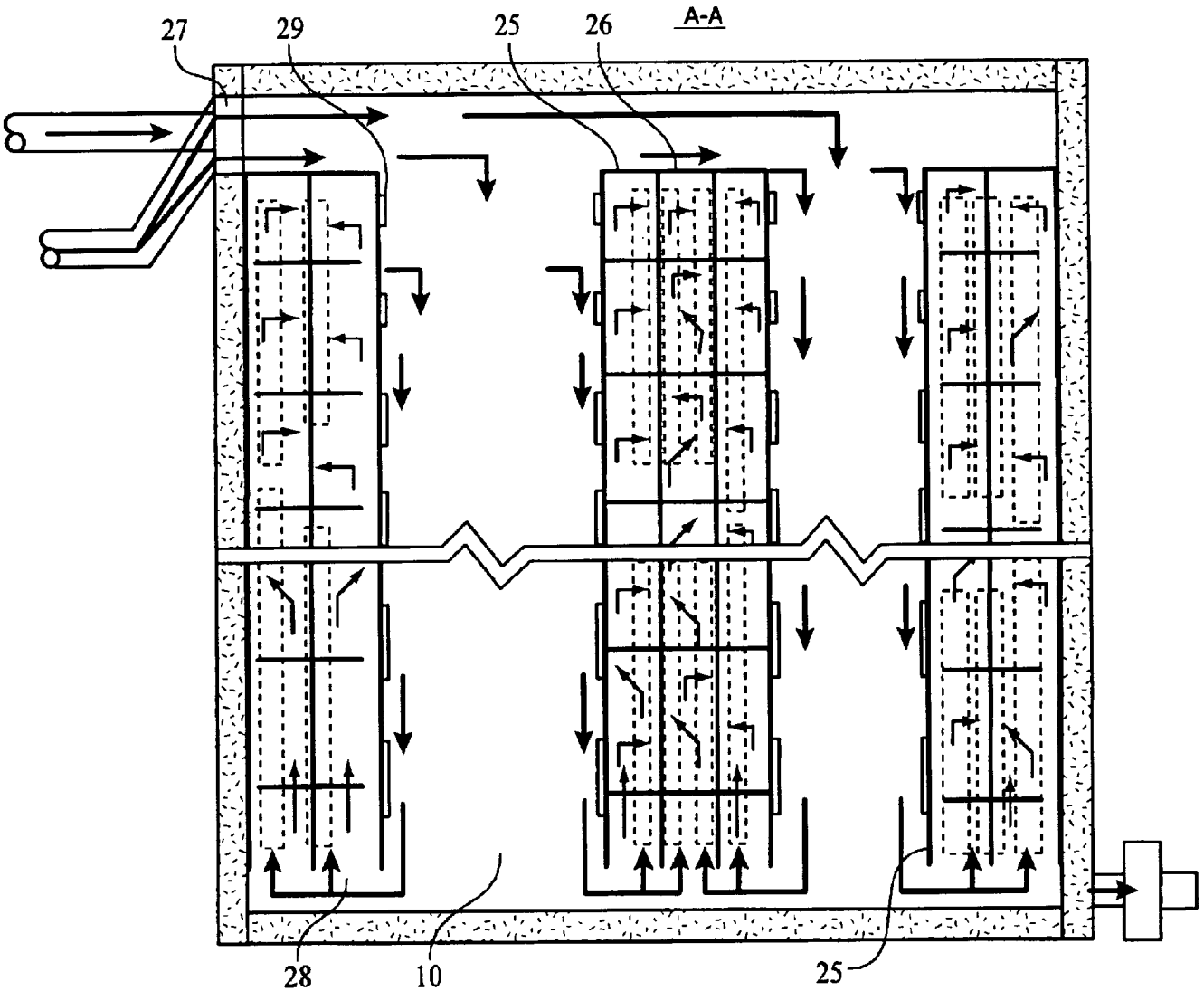
FIG. 2 gives an A—A section of FIG. 1.
Figure 3:
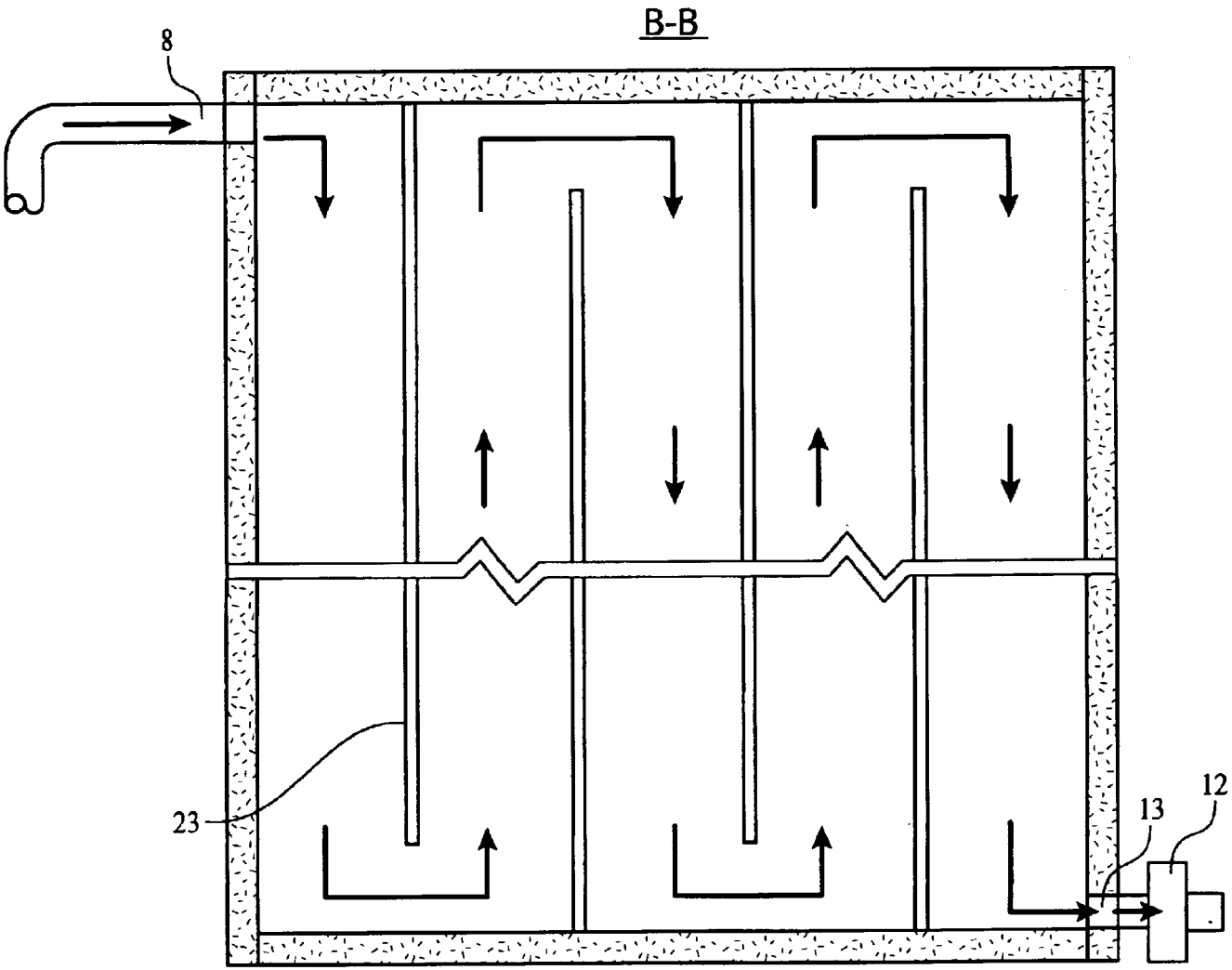
FIG. 3 gives an B—B section of FIG. 1.
Figure 4:
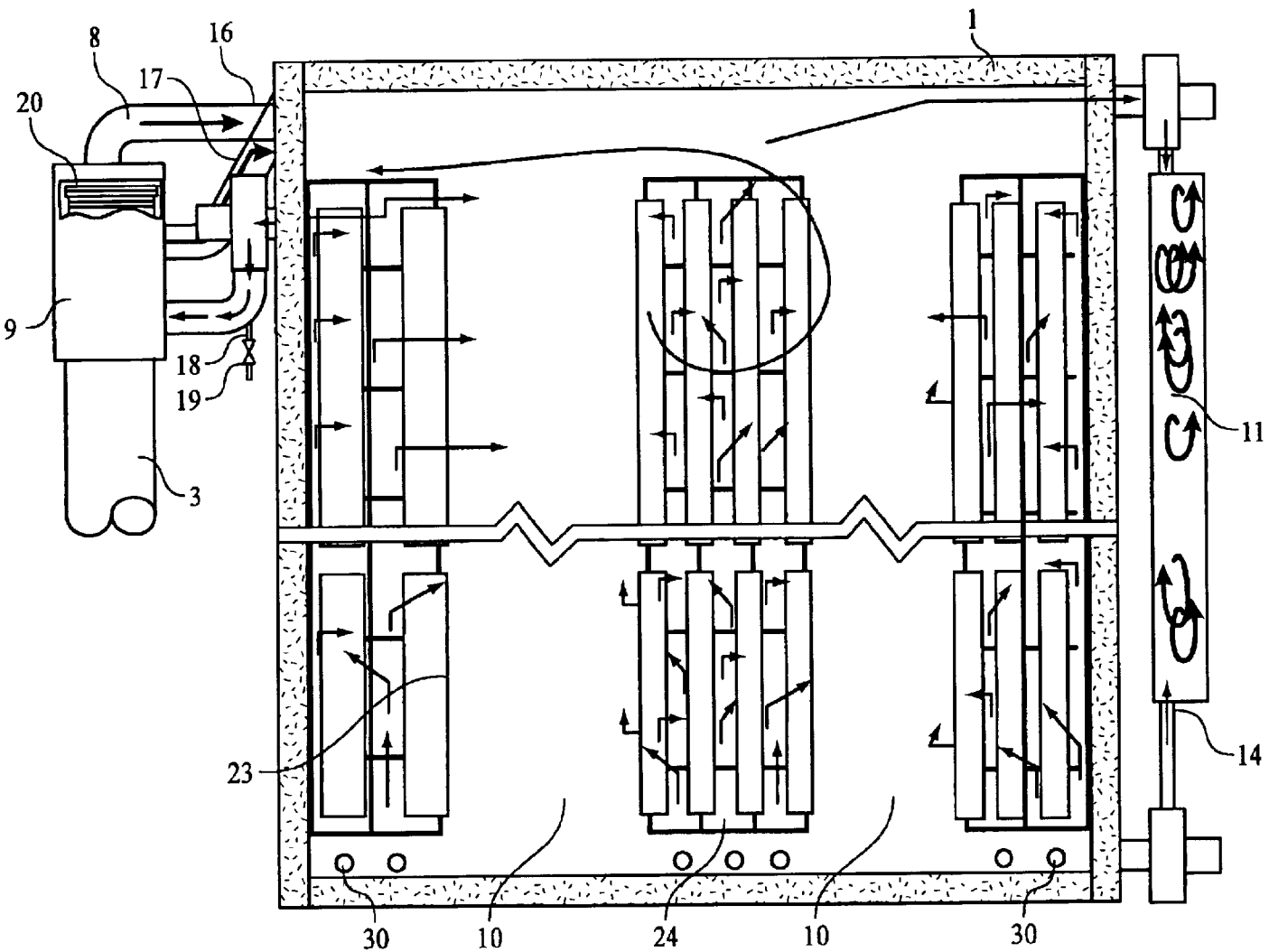
FIG. 4 gives an C—C section of FIG. 1.

The drying plant consists of the heat-insulated drying chamber (1) with the free internal space (2), the furnace (3) located close to the drying chamber (1), the bottom of the drying chamber (4) that is designed with two cavities (5 and 6), horizontally arranged and separated from each other by the hermetic partition (7) made of diathermic material. The lower cavity (5) in the bottom (4) of the drying chamber (1) is designed in such a way as to provide forced feeding of furnace gases into the cavity (5) from the exhaust pipe (8) of the furnace flue (9). The upper cavity (6) in the bottom (4) of the drying chamber (1) is designed in such a way as to provide feeding of the air (drying agent) heated in the furnace flue (9) into said cavity (6); in the upper cavity (6), the heated air is distributed among the air distribution channels (10) to interact with the material to be dried located in the free internal space of the drying chamber (1). There is a possibility to provide forced feeding of a portion of the air, being cooled and humidified during drying, from the upper part of the drying chamber (1) into the furnace flue (9). The drying plant is equipped with the condensate cleaning unit (11) located outside the drying chamber (1); furnace gases are forcedly fed into the cleaning unit (11) from the exhaust pipe (8) of the furnace flue (9) after they pass through the lower cavity (5) in the bottom (4) of the drying chamber (1); also, a portion of the air cooled and humidified during drying is forcedly fed into the cleaning unit (11) from the upper part of the free internal space of the drying chamber (1) for mixing up with the furnace gases to form a condensate; subsequently, purified air is exhausted into atmosphere.

The facilities that forcedly supply furnace gases from the exhaust pipe (8) of the furnace flue (9) into the lower cavity (5) in the bottom of the drying chamber (1) and into the condensate cleaning unit (11) after they pass through the lower cavity (5), are designed in the form of the first exhaust ventilator (12) located outside the drying chamber (1) and condensate cleaning unit (11), and connected to the outlet (13) of the lower cavity (5) in the bottom (4) of the drying chamber (1) and to the inlet (14) of the condensate cleaning unit (11).

The facilities that supply a portion of cooled and humidified air from the upper part of the free internal space (2) of the drying chamber (1) into the condensate cleaning unit (11) are designed in the form of the second exhaust ventilator (15) located outside the drying chamber (1) and the condensate cleaning unit (11) and connected to both of them.

The facilities that bleed a portion of cooled and humidified air from the upper part of the free internal space (2) of the drying chamber (1) and supply it into the furnace flue (9) are designed in the form of the third exhaust ventilator (16) connected both to the drying chamber (1) and the furnace flue (9) so as to provide the closed air circulation from the upper part of the free internal space (2) of the drying chamber (1) into the furnace flue (9) and from the furnace flue (9) into the upper cavity (6) in the bottom (4) of the drying chamber (1) and further into the free internal space (2) of the drying chamber (1). The casing (17) of the third exhaust ventilator (16) is connected to the outgoing pipe (18) intended to discharge into atmosphere moisture, which is accumulated on the internal surface of the casing (17) as a result of condensation of water vapor in the cooled air, bled by the third exhaust ventilator (16) from the upper part of the free internal space (2) of the drying chamber (1). The outgoing pipe (18) is equipped with the shutter (19) to adjust humidity conditions of the drying process. The furnace flue (9) contains the pipe (20), where the air is heated by the furnace gases and then fed into the drying chamber (1) and backwards. The pipe (20) is curved many times to increase the way and time for the air to go through the furnace flue (9).

The shutter (22) for adjusting temperature conditions of the drying process is installed in the channel (21), designed for air supplying into the furnace flue (9) and further into the upper cavity (6) in the bottom (4) of the drying chamber (1).

The lower cavity (5) in the bottom (4) of the drying chamber (1) is equipped with at least two partitions (23) to provide labyrinth passing of furnace gases in the lower cavity (5) in the bottom (4) of the drying chamber (1). The air distribution channels (10) are located between and along the areas for placing the material to be dried. Each air distribution channel (10) is separated with a vertical partition (25) from an adjacent area (24) for placing the material to be dried.

The areas (24) for placing the material to be dried are located on/above the upper surface of the diathermic partition, which separates the lower (5) and upper (6) cavities in the bottom (4) of the drying chamber (1) so as to allow heated air to pass through the material to be dried; the heated air is moving up to the upper part of the free internal space (2) of the drying chamber (1).

The areas for placing the material to be dried (24) are equipped with vertical partitions (26) to direct and distribute the heated air incoming from the pipe (20) of the furnace flue (9) via the inlet (27) of the upper cavity (6) in the bottom (4) of the drying chamber (1) through the air distribution channels (10). There is a possibility to supply the heated air to the material being dried located in the specially arranged areas (24) after it passes the air distribution channels (10) through the free space (28) of the upper cavity (6) in the bottom (4) of the drying chamber (1), which is adjacent to the ends of the areas for placing the material to be dried (24). Additional heated air supply to the material being dried is provided via the through holes (29) in the vertical partitions (25) that separate the areas for placing the material to be dried (24) from the air distribution channels (10). These holes (29) have different diameters that increase along the way of heated air passage via the air distribution channels (10). In the upper surface of the upper cavity (6) in the bottom of the drying chamber, close to one of its lateral walls, there are the through holes (30), which provide additional hot air supply from the upper cavity (6) in the bottom (4) of the drying chamber (1) into the free internal space (2) of the drying chamber (1). In case the drying chamber (1) is used for drying saw-timber piles, the piles are located in the drying chamber (1) along the air distribution channels (10) so that the ends of the piles are opposite to said through holes (30).

When the drying chamber (1) is not completely loaded, it is possible to close the air distribution channel (10) adjacent to the area for placing the material to be dried, which contains no material.

The condensate cleaning unit (11) is designed in the form of a hollow reservoir to ensure condensation on its internal walls when cooled and humidified air fed from the upper part of the free internal space (2) of the drying chamber (1) gets mixed up with the furnace gases from the lower cavity (5) in the bottom (4) of the drying chamber (1). The power capacity of the third exhaust ventilator (16) relates to the power capacity of the second exhaust ventilator (15) as 10:1.

Industrial Application

The operation of the proposed drying plant may be demonstrated with an example of implementing the method of drying wood, namely, saw-timber stacked in piles.

The furnace (3) is put in operation by igniting the fuel (woodworking waste products) in the combustion chamber. Simultaneously, the first exhaust ventilator (12) is turned on. The saw-timber stacked in piles is placed in the specially arranged areas (24) in the free internal space (2) of the drying chamber (1). After the drying chamber (1) is loaded and its doors, equipped with appropriate seals, are hermetically locked, the second (15) and third (16) exhaust ventilators are turned on. At this time, the shutter (19) in the outgoing pipe (18), connected to the casing (17) of the third exhaust ventilator, (16) is shut. When the temperature and humidity in the drying chamber (1) reach required values the shutter (19) should be opened. Then, the drying plant runs in a set mode of operation. The only maintenance required is to load fuel in the combustion chamber and remove ashes in time.

During the operation of the drying plant, the drying agent, i.e. the air heated by the furnace gases in the pipes (20)

located in the furnace flue (9), enters the upper cavity (6) in the bottom (4) of the drying chamber (1) through the channel (21), and then goes through the air distribution channels (10) to the areas (24), where it passes through the piles of the material to be dried, then the air goes up to the top of the drying chamber (1), where it is partially bled by the second (15) and the third (16) exhaust ventilators. The proposed and described above location of the air distribution channels (10), relative to the areas for placing the material to be dried (24) and relative to the direction of heated air entering the upper cavity (6) in the bottom (4) of the drying chamber (1), ensures uniform distribution of heated air among the piles. Uniform distribution of heated air is also insured by additional supply of heated air to the piles via the through holes (30) in the upper surface of the upper cavity (6) in the bottom (4) of the drying chamber (1) and/or via the through holes (29) in the vertical partitions (25), which separate the areas for placing the material to be dried (24) from the air distribution channels (10).

During the operation of the drying plant, due to the action of the third exhaust ventilator (16), the air is circling in a closed circuit sequentially passing through the pipes (20) located in the furnace flue (9), the inlet part of the channel (21), the upper cavity (6) in the bottom (4) of the drying chamber (1) with its air distribution channels (10), then through the piles (in case saw-timber is dried) the air goes up to the upper part of the free internal space (2) of the drying chamber (1), and then again it passes through the channel (21) into the pipes (20) located in the furnace flue (9), etc. Thus, convectional drying of wet materials with heated air is realized in the drying chamber (1). While moving up to the upper part of the free internal space (2) of the drying chamber (1) and contacting the material to be dried, heated air becomes wet and partially cools down, because some heat is consumed for moisture evaporation and wood heating.

During drying, a part of cooled and humidified air from the upper part of the free internal space (2) of the drying chamber (1) is fed by the second exhaust ventilator (15) to the condensate cleaning unit (11), where it gets mixed up with the furnace gases supplied to the unit (11) by the first exhaust ventilator (12). On the way to the condensate cleaning unit (11) the furnace gases pass through the lower cavity in the bottom (4) of the drying chamber (1), heating said chamber (1).

Humidity conditions of the drying process can be adjusted by opening up the shutter (19) in the outgoing pipe (18), through which the condensate, forming on the internal surface of the casing of the third exhaust ventilator (16), when cooled and humidified air passes through the ventilator (16) from the upper part of the free internal space (2) of the drying chamber (1), is discharged into atmosphere.

Temperature conditions of the drying process can be regulated by adjusting the amount of heated air supply from the pipes (20) located in the furnace flue (9) to the drying chamber, temperature conditions can also be regulated by adjusting the temperature of heated air that depends on the intensity of fuel burning in the furnace (3).

The proposed drying plant and wood-drying method ensure a highly productive, cost-effective and nonpolluting drying process.

The heated air moves from the bottom to the top of the drying chamber (1), thus ensuring maximum heat transfer to the material being dried without any loss. Such air-moving (from the bottom to the top of the drying chamber (1)) does not require any additional power-consuming devices, since the heated air is lighter in weight than the cold air, and the air humidified during elevation is lighter in weight than the dry air at the same temperature. These properties of air provide natural airflow and lay the foundation of operation of the drying chamber (1) of the proposed drying plant.

Designing the drying chamber (1) equipped with a lower cavity (5) in its bottom (4), which the furnace gases (smoke), formed during fuel burning in the combustion chamber (1) of the furnace (3), pass through, allows to use the warmth of the furnace gases for additional heating of the drying chamber (1), promoting a higher cost-effectiveness of the proposed drying plant. And subsequent condensate purification of cooled furnace gases ensures an increased environmental safety of the proposed drying plant, which allows to run it in any circumstances without environmental pollution, since there is virtually no discharge of harmful substances into atmosphere.

Supplying heated air to the material being dried through the proposed and described air distribution channels (10) of the upper cavity (6) in the bottom (4) of the drying chamber (1) provides the uniform distribution of heated air among the material being dried (especially, in case saw-timber is being dried) located in the specially arranged areas (24).

The foregoing allows one to claim that the above listed advantages of the proposed drying plant may be realized only by exploiting all its features as a whole, each feature has its own function, whereas taken as a whole they contribute solving the problem.

What is claimed is:

1. A drying plant, for drying wood, comprising a heat-insulated drying chamber with an internal space for drying wood, a furnace located near the drying chamber, facilities for supplying a drying agent from the furnace to the drying chamber, distinctive in that the bottom of the drying chamber is designed with two cavities horizontally arranged and separated from each other by a hermetic partition made of diathermic material, the lower cavity in the bottom of the drying chamber is designed for forced feeding of furnace gases into the lower cavity from an exhaust pipe of a furnace flue, the upper cavity in the bottom of the drying chamber is designed for feeding of the air heated in the furnace flue into the upper cavity; in the upper cavity, the heated air, used as a drying agent, is distributed among air distribution channels to interact with a material to be dried, located in specially arranged areas in the internal space of the drying chamber; besides that, a portion of air, cooled and humidified during drying, may be forcedly fed from the upper part of the drying chamber into the furnace flue, the plant is also equipped with a condensate cleaning unit located outside the drying chamber, the condensate cleaning unit is forcedly fed with furnace gases after they pass through the lower cavity in the bottom of the drying chamber, the condensate cleaning unit is also fed with a portion of air, cooled and humidified during drying, from the upper part of the internal space of the drying chamber for mixing up with furnace gases to form a condensate and for subsequent exhausting of purified air.

2. The drying plant according to claim 1, wherein the facilities for forced feeding of furnace gases from an exhaust pipe of the furnace flue into the lower cavity of the bottom of the drying chamber and into the condensate cleaning unit after said gases pass through the lower cavity, are designed in a form of a first exhaust ventilator, located outside the drying chamber and outside the condensate cleaning unit and connected to an outlet of the lower cavity of the bottom of the drying chamber and to an inlet of the condensate cleaning unit.

3. The drying plant according to claim 1, wherein the facilities for supplying a portion of cooled and humidified air from the upper part of the internal space of the drying chamber to the condensate cleaning unit are designed in a form of a second exhaust ventilator, located outside the drying chamber and outside the condensate cleaning unit and connected to both the drying chamber and the condensate cleaning unit.

4. The drying plant according to claim 1, wherein the facilities for bleeding a portion of cooled and humidified air from the upper part of the internal space of the drying chamber and supplying said air into the furnace flue are designed in a form of a third exhaust ventilator connected to both the drying chamber and the furnace flue so as to provide closed air circulation from the upper part of the internal space of the drying chamber into the furnace flue and from the furnace flue into the upper cavity of the bottom of the drying chamber and further into the internal space of the drying chamber.

5. The drying plant according to claim 4, wherein a casing of the third exhaust ventilator is connected to an outgoing pipe, designed to discharge into atmosphere moisture, which is accumulated on the internal surface of the casing as a result of condensation of cooled and humidified air, bled by the third exhaust ventilator from the upper part of the internal space of the drying chamber.

6. The drying plant according to claim 5, wherein the outgoing pipe is equipped with a shutter to adjust humidity conditions of drying.

7. The drying plant according to claim 1, wherein the furnace flue contains a pipe, where the air is heated by furnace gases and fed into the drying chamber and backwards providing the process of drying.

8. The drying plant according to claim 7, wherein said pipe, located in the furnace flue, is curved many times to increase the way and time for the air to go through the furnace flue.

9. The drying plant according to claim 1, wherein the shutter for adjusting required and assigned temperature conditions of drying is installed in a channel, used for supplying hot air from the furnace flue to the upper cavity of the bottom of the drying chamber.

10. The drying plant according to claim 1, wherein the lower cavity of the bottom of the drying chamber is equipped with at least two partitions to provide labyrinth passing of furnace gases in the lower cavity of the bottom of the drying chamber.

11. The drying plant according to claim 1, wherein the air distribution channels are located perpendicular to a heated airflow, entering the upper cavity of the bottom of the drying chamber, between and along areas for placing a material to be dried, each of the air distribution channels is separated with a vertical partition from an adjacent area for placing a material to be dried.

12. The drying plant according to claim 1, wherein the areas for placing a material to be dried are located on or above the upper surface of the diathermic partition, which separates the lower and upper cavities in the bottom of the drying chamber so as to allow heated air to pass through a material being dried when said air is moving up to the upper part of the internal space of the drying chamber, the areas for placing a material to be dried are equipped with vertical partitions to direct and distribute heated air, incoming from the inlet of the upper cavity of the bottom of the drying chamber, among the air distribution channels.

13. The drying plant according to claim 1, wherein heated air reaches a material to be dried after passing in the air distribution channels through the free space of the upper cavity of the bottom of the drying chamber, which constrains areas for placing a material to be dried.

14. The drying plant according to claim 1, wherein heated air can be additionally supplied to a material being dried via through holes in the vertical partitions, which separate areas for placing a material to be dried from air distribution channels.

15. The drying plant according to claim 14, wherein the diameters of said through holes increase along the way of heated air passage via an air distribution channel.

16. The drying plant according to claim 14, wherein said through holes are equipped with shutters.

17. The drying plant according to claim 1, wherein through holes for additional heated air supply from the upper cavity of the bottom of the drying chamber to the internal space of the drying chamber are designed in the upper surface of the upper cavity of the bottom of the drying chamber and near one of the walls of the drying chamber.

18. The drying plant according to claim 17, wherein, in case of drying saw-timber piles, the piles are located in the drying chamber along the air distribution channels so that the ends of said piles are opposite to said through holes.

19. The drying plant according to claim 1, wherein, in case of partial loading of the drying chamber, it is possible to close the air distribution channel adjacent to any area for placing a material to be dried, which contains no material.

20. The drying plant according to claim 1, wherein the condensate cleaning unit is designed in a form of a hollow reservoir to make possible condensation on the internal walls of the condensate cleaning unit, while cooled and humidified air, fed from the upper part of the internal space of the drying chamber, is mixing up with the furnace gases, fed from the lower cavity of the bottom of the drying chamber.

21. The drying plant according to claim 1, wherein the power capacity of the third exhaust ventilator is higher than the power capacity of the second exhaust ventilator.

22. The wood drying method, consisting of stacking wood into the internal space of the drying chamber, closing the drying chamber, and supplying a hot drying agent to the drying chamber; a fuel is being burnt in a combustion chamber of a furnace located near the drying chamber, distinctive in that the air, heated in the pipes located in the furnace flue, is used as the drying agent; said air is forcedly circulated from pipes located in the furnace flue to the lower part of the internal space of the drying chamber, and from the upper part of the internal space of the drying chamber to the pipes of the furnace flue, and backwards; during drying, a portion of cooled and humidified air is forcedly supplied from the upper part of the internal space of the drying chamber into the condensate cleaning unit, where said portion of air is mixing up with the furnace gases, which are forcedly supplied to the condensate cleaning unit for purification; on the way to the condensate cleaning unit, the furnace gases pass through a cavity, designed in the bottom of the drying chamber, heating said bottom.

23. The wood drying method according to claim 22, wherein the air circulation from the pipes of the furnace flue to the lower part of the internal space of the drying chamber, and from the upper part of the internal space of the drying chamber to the pipes located in the furnace flue, and forced supply of furnace gases from the furnace flue through an exhaust pipe to the cavity of the bottom of the drying chamber and then to the condensate cleaning unit, and also force supply of a portion of cooled and humidified air from the upper part of the internal space of the drying chamber to the condensate cleaning unit, is realized with the aid of three appropriate exhaust ventilators providing gradual decrease of pressure in the internal space of the drying chamber during drying.

24. The wood-drying method according to claim 22, wherein humidity conditions of drying are adjusted by releasing vapor from the upper part of the internal space of the drying chamber into atmosphere.

25. The wood-drying method according to claim 22, wherein temperature conditions of drying are regulated by adjusting the amount of heated air supply from the pipes located in the furnace flue to the lower part of the internal space of the drying chamber, and also by adjusting the temperature of heated air, which depends on the intensity of fuel combustion in the furnace and on the amount of fuel being burnt.

* * * * *